US007328951B2

(12) United States Patent
Ward et al.

(10) Patent No.: US 7,328,951 B2
(45) Date of Patent: Feb. 12, 2008

(54) ALL-TERRAIN SEAT

(75) Inventors: William S. Ward, 141A Boatyard Dr., Fort Bragg, CA (US) 95407; Robert W. Ryall, Mesa, AZ (US)

(73) Assignee: William S. Ward, Fort Bragg, CA (US)

( * ) Notice: Subject to any disclaimer, the term of this patent is extended or adjusted under 35 U.S.C. 154(b) by 0 days.

(21) Appl. No.: 11/265,441

(22) Filed: Nov. 1, 2005

(65) Prior Publication Data

US 2006/0170267 A1 Aug. 3, 2006

Related U.S. Application Data

(60) Provisional application No. 60/624,400, filed on Nov. 1, 2004.

(51) Int. Cl.
*A47C 12/00* (2006.01)

(52) U.S. Cl. ..... 297/344.18; 297/440.1

(58) Field of Classification Search ..... 297/344.18, 297/16.1, 16.2, 440.1; 248/163.1, 165, 439, 248/188.8, 188.5
See application file for complete search history.

(56) References Cited

U.S. PATENT DOCUMENTS

| | | | | |
|---|---|---|---|---|
| 3,177,035 | A * | 4/1965 | Halstrick | 297/451.1 |
| 4,934,638 | A * | 6/1990 | Davis | 248/164 |
| 5,364,163 | A | 11/1994 | Hardison | |
| 5,494,333 | A * | 2/1996 | Wilson | 297/344.18 |
| 5,522,642 | A * | 6/1996 | Herzog | 297/344.18 |
| 6,010,183 | A | 1/2000 | Perkins | |
| 6,634,704 | B1 * | 10/2003 | Bergquist | 297/16.2 |
| 6,899,388 | B1 * | 5/2005 | Enrique | 297/184.16 |

* cited by examiner

*Primary Examiner*—Peter R. Brown
(74) *Attorney, Agent, or Firm*—Snell & Wilmer LLP

(57) ABSTRACT

A new and improved all-terrain seat that is ideal for hunting, fishing, backpacking, camping, sports viewing, and the like. The all-terrain seat includes legs that are individually adjustable enabling the seat to be securely positioned on any surface, regardless of incline. The all-terrain seat is made from a lightweight material and is very portable as it may attach to a belt, easily fit inside a backpack, or be hand carried.

5 Claims, 3 Drawing Sheets

ALL-TERRAIN SEAT

CROSS-REFERENCE TO RELATED APPLICATIONS

This application claims priority to, and the benefit of, U.S. Provisional Patent Application Ser. No. 60/624,400, entitled "ALL-TERRAIN SEAT" and filed Nov. 1, 2004.

TECHNICAL FIELD

The present invention relates generally to chairs and, more particularly, to an all-terrain, lightweight seat that is especially adapted for sloped or uneven surfaces.

BACKGROUND INFORMATION

Many outdoor activities take place in terrain that is not flat. For example, hunters often have to trek through terrain that is uneven when pursuing elk or other prey. When set up to call an elk or other prey into gun or bow range, it is best to be concealed in a sitting or kneeling position. This often requires sitting or kneeling, for long periods of time, on ground that is rough and uneven.

Many weapons, such as a bow that is used for bowhunting, require a clearance of six inches or more. Therefore, it is often not possible to sit on the ground. However, kneeling is also undesirable, as it becomes uncomfortable in a short period of time. Thus, a hunter often has to spend a considerable amount of time searching for a log or stump that provides enough clearance for their weapon.

Chairs especially designed for outdoor activities such as hunting or fishing are well known in the art. For example, U.S. Pat. No. 6,010,183 discloses a hunting seat for inclined surfaces that includes a planar cushion with a transverse anchor pad. However, this seat is undesirable as it places the hunter close to the ground and does not provide enough clearance to enable a hunter to use a bow as described above.

Many of these chairs even have adjustable-length legs. For example, U.S. Pat. No. 5,364,163 discloses an adjustable leg, fishing chair with a leg assembly having spike members for penetrating into a sloped ground surface. The chair has U-shaped telescoping front and back leg members. However, this chair is designed for the slope of a riverbank and is not easily adaptable to very rough, mountainous terrain that may be too hard to penetrate with spikes. In addition, this chair also requires the front and back leg members to be adjusted as paired units.

U.S. Pat. No. 5,494,333 discloses a hillside chair with individually adjustable legs. However, this hillside chair is a folding chair that is too cumbersome for the hunter who needs a lightweight, easily packable chair for the long trek in pursuit of prey.

Although there are many chairs designed for hunting, fishing and other outdoor activities. These chairs have shortcomings as described above. Therefore, a need exists for a lightweight, easily packable, all-terrain chair that provides sufficient clearance for the hunter and other users of the chair.

BRIEF DESCRIPTION OF THE DRAWINGS

A more complete understanding of the present invention may be derived by referring to the detailed description when considered in connection with the Figures, where like reference numbers refer to similar elements throughout the Figures, and.

DETAILED DESCRIPTION OF EXEMPLARY EMBODIMENTS

Embodiments of the present invention allow a user (e.g., hunter, sports spectator, camper, hiker, bird watcher, and the like) to use an all-terrain seat that is adjustable to fit any type of terrain. By individually adjusting the legs of the all-terrain seat, users are able to use the all-terrain seat on terrains of any incline. Moreover, the all-terrain seat may be used near obstructions such as trees, buildings, and the like, so that a hunter or other user can sit in very close proximity to the obstruction.

The following detailed description of exemplary embodiments of the invention makes reference to the accompanying Figures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the following detailed description is presented for purposes of illustration only and not of limitation. For example, the steps recited in any of the method or process descriptions may be executed in any order and are not limited to the order presented.

Figure 1:
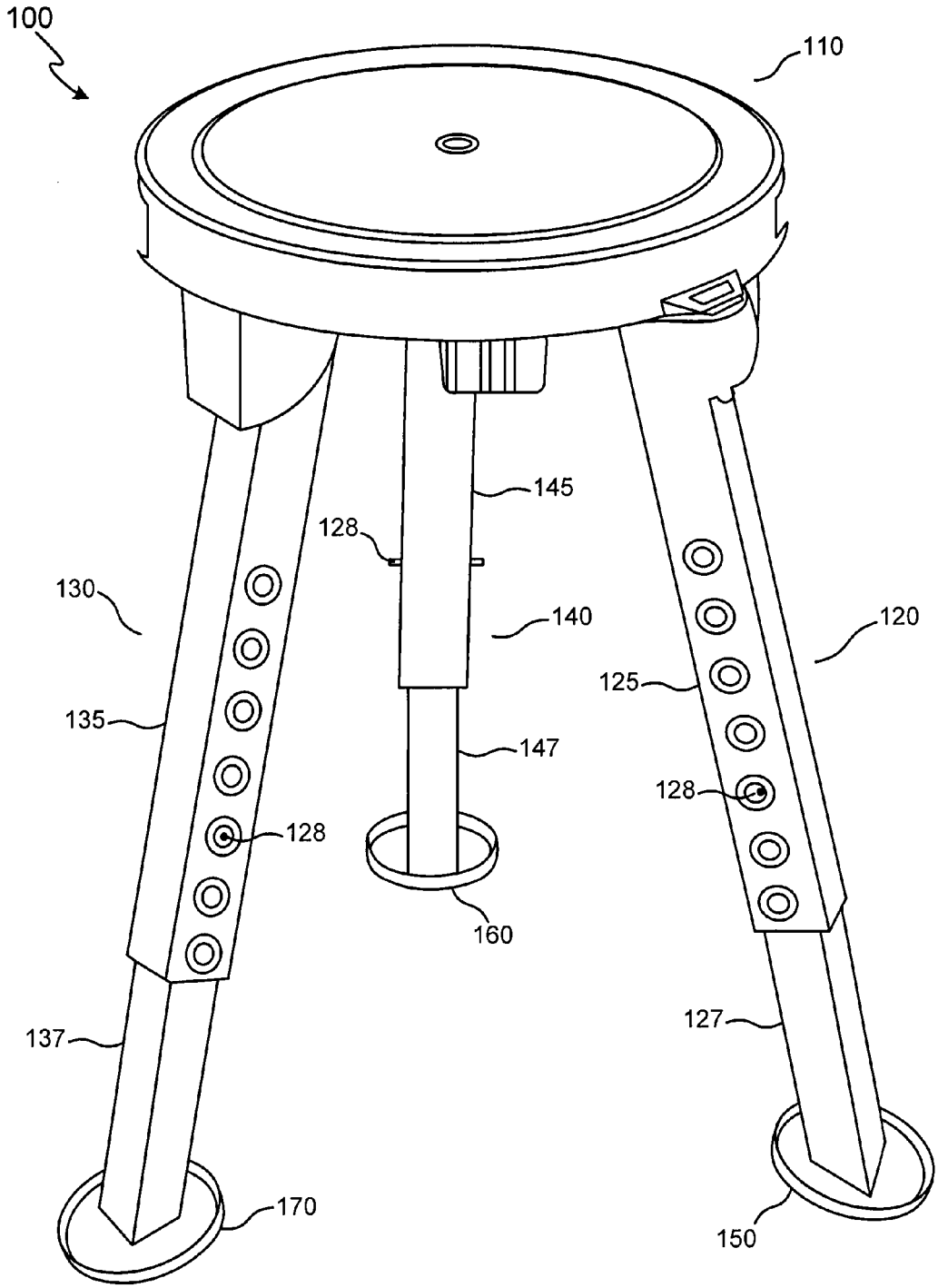
FIG. 1 illustrates a perspective view of a seat in accordance with one embodiment of the present invention.

Turning now to the figures, FIG. 1 shows a perspective view of an embodiment of the all-terrain seat 100 of the present invention. The illustrated embodiment of all-terrain seat 100 includes a seat assembly 110 and leg members 120, 130, and 140 that support seat assembly 110. Each leg member comprises an upper and lower leg section. Leg member 120 comprises upper leg section 125 and lower leg section 127. Leg member 130 comprises upper leg section 135 and lower leg section 137. Leg member 140 comprises upper leg section 145 and lower leg section 147.

The upper and lower leg sections are removably attached such that each lower leg section 127, 137, 147 is configured to slide into and traverse the inside of the respective upper leg section 125, 135, 145. In this manner, the upper and lower sections for each leg member are individually adjustable. That is, the user may adjust only one, two, or all three leg members, depending on the incline and other characteristics of the surface. Alternatively, in accordance with other embodiments of the present invention, the lower leg sections could be configured to traverse the outside of the respective leg section.

In addition, leg caps 150, 160, and 170 may be attached to one end of lower leg sections 127, 137, 147 respectively, such that the leg caps make contact with the surface or terrain and may be used to further stabilize seat 100. It will be appreciated that leg caps 150, 160, 170 distribute the load so that seat 100 may be used on any type of surface, including soft surfaces.

Figure 3:
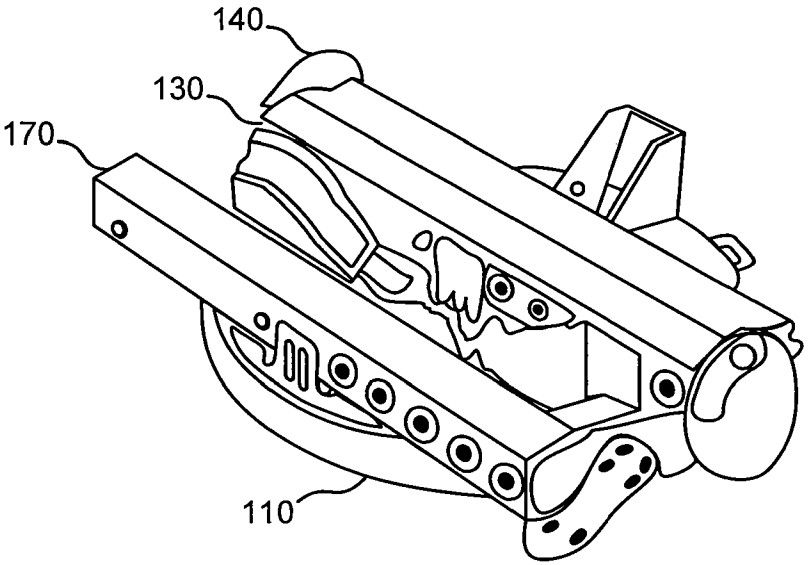
FIG. 3 illustrates a perspective view of a folded up seat in accordance with the embodiment illustrated in FIG. 1.

In accordance with another aspect of the present invention, and with reference to FIGS. 1 and 3, the adjustable leg sections of each leg member have push buttons 128, that allow the leg sections to easily attach, detach, and adjust for height. Thus, the legs may be individually adjusted so that the user can sit on any surface. At the touch of a push button, the legs may be detached and attached to seat assembly 110 for easy transport as illustrated in FIG. 3. In accordance with another aspect of this embodiment, seat assembly 110 also comprises a quiet ball bearing raceway that enables the seat assembly to swivel 360 degrees. In accordance with another aspect of this embodiment, the legs may be adjusted to at least 20 inches in height, and lightweight seat (approximately 3.0 pounds) 100 is capable of supporting an individual weighing more than 350 pounds.

Figure 2:
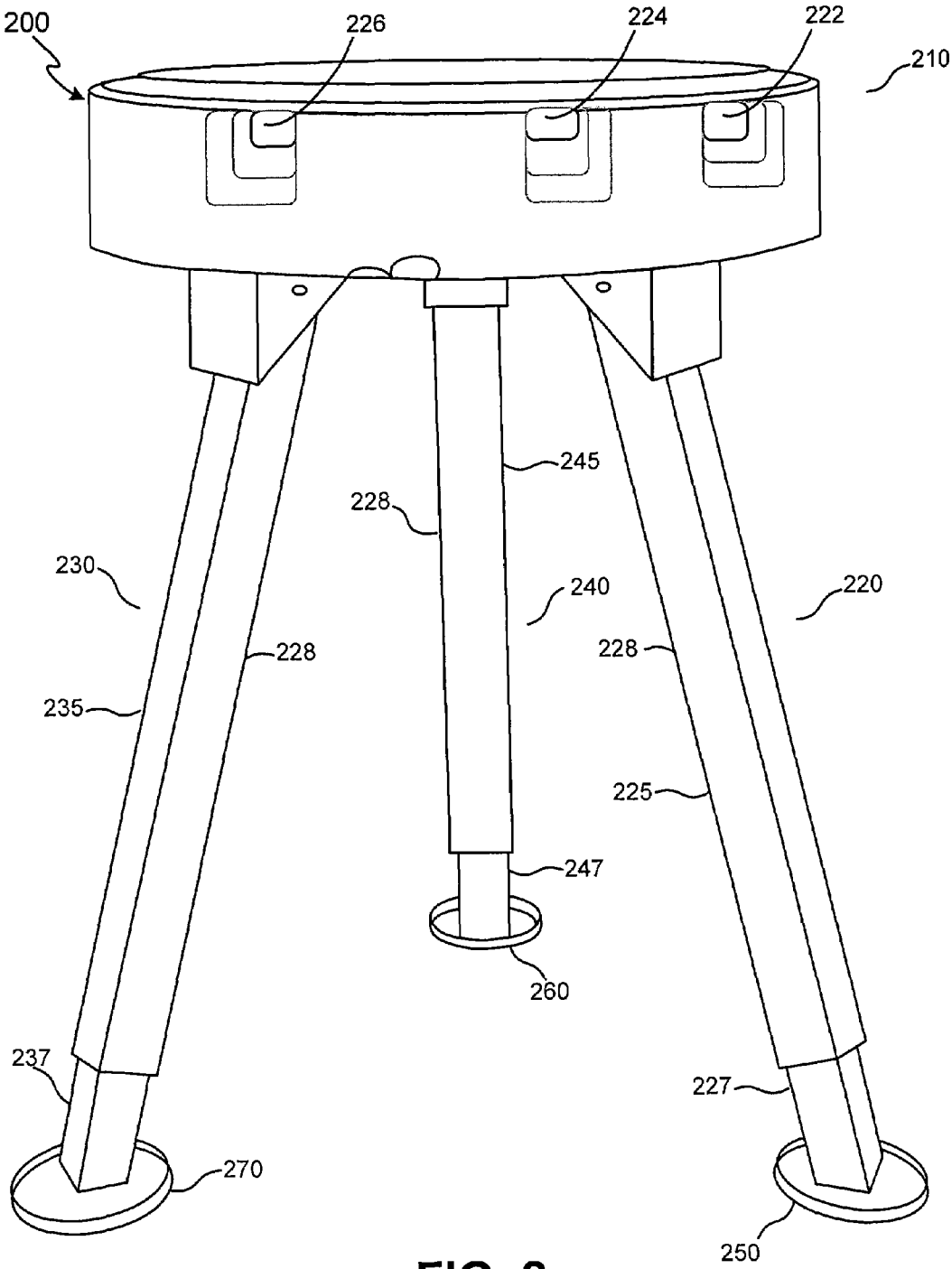
FIG. 2 illustrates a perspective view of a seat in accordance with another embodiment of the present invention.

FIG. 2 shows a perspective view of another embodiment of an all-terrain seat 200 of the present invention. The illustrated embodiment of all-terrain seat 200 includes a seat assembly 210, channels 222, 224, 226 and leg members 220, 230, and 240 that support seat assembly 210. Each leg member comprises an upper and lower leg section. Leg member 220 comprises upper leg section 225 and lower leg section 227. Leg member 230 comprises upper leg section 235 and lower leg section 237. Leg member 240 comprises upper leg section 245 and lower leg section 247.

Seat assembly 210 has channels 222, 224, 226 that are approximately parallel and extend through the seat assembly. In this manner, leg members 220, 230, 240 may be stored in the channels for easy transport as described below.

The upper and lower leg sections are removably attached such that each lower leg section 227, 237, 247 is configured to slide into and traverse the inside of the respective upper leg section 225, 235, 245. In this manner, the upper and lower sections for each leg member are individually adjustable. That is, the user may adjust only one, two, or all three leg members, depending on the incline and other characteristics of the surface. Alternatively, in accordance with other embodiments of the present invention, the lower leg sections could be configured to traverse the outside of the respective leg section.

In addition, leg caps 250, 260, and 270 may be attached to one end of lower leg sections 227, 237, 247 respectively, such that the leg caps make contact with the surface or terrain and may be used to further stabilize seat 200. It will be appreciated that leg caps 250, 260, 270 distribute the load so that seat 200 may be used on any type of surface, including soft surfaces.

Figure 4:
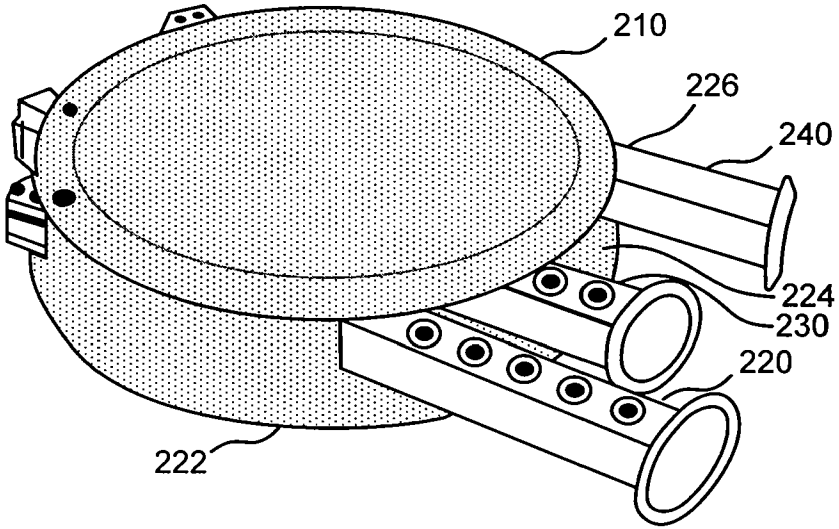
FIG. 4 illustrates a perspective view of a folded up seat in accordance with the embodiment illustrated in FIG. 2.

In accordance with another aspect of the present invention, and with reference to FIGS. 2 and 4, the adjustable leg sections of each leg member have push buttons 228, that allow the leg sections to easily attach, detach, and adjust for height. Thus, the legs may be individually adjusted so that the user can sit on any surface. At the touch of a push button, the legs may be detached and slide into channels 222, 224, 226 on seat assembly 210 for easy transport. In accordance with another aspect of this embodiment, seat assembly 210 also comprises a quiet ball bearing raceway that enables the seat assembly to swivel 360 degrees. In accordance with another aspect of this embodiment, the legs may be adjusted from at least 16.5 inches to at least 23.5 inches in height, and seat 200 is capable of supporting an individual weighing more than 500 pounds. The seat is made from light weight, high impact strength plastic and thus the seat, in this embodiment, may weigh less than 5 pounds.

In accordance with another embodiment of the present invention, and with reference to the accompanying figures, a "spike seat" model comprises a very lightweight adjustable leg seat that has individually adjustable legs that may extend up to 18 inches in height. The lower leg sections of this embodiment may optionally have spikes such that the seat can securely sit on various types of terrain. In accordance with one aspect of this embodiment, the seat weighs approximately three pounds due to the use of lightweight, high impact strength plastic.

It will be appreciated that all-terrain seat 100, 200 has, inter alia, the following advantages:

individually adjustable legs—can be used on grass, in the woods, on the beach, and is designed for use on sloped or uneven surfaces.

lightweight—made from high impact strength plastic.

exceptionally portable—attaches to belt on waist, fit inside a backpack, or easily hand carried.

oversized leg caps—distributes the load so the seat can be used on all surfaces.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical".

What is claimed is:

1. A seat for use on an inclined surface comprising:

a seat assembly to form a seating surface on a top surface of the seat assembly, wherein the seat assembly has a plurality of channels formed proximate to a lower surface of the seat assembly;

a plurality of individually adjustable leg members to support the seat assembly; and wherein each of the leg members comprises an upper and lower leg section such that each of the lower leg sections is attached to the respective upper leg section for the leg member, and the lower leg section is configured to traverse into the respective upper leg section such that a length of each leg member is individually adjustable, wherein each leg member is detachable from the seat assembly and each of the detached leg members may be stored in the plurality of channels in the seat assembly, wherein the lower leg section is positioned into the respective upper leg section when the leg member is stored.

2. The seat of claim 1, wherein the seat assembly further comprises a ball bearing raceway and the scat assembly is configured to swivel within the ball bearing raceway.

3. The seat of claim 1, wherein each lower leg section further comprises a leg cap that is positioned on an end of the leg section that contacts the surface.

4. The seat of claim 1, wherein each lower leg section further comprises a spiked end on the end of the leg section that contacts the surface.

5. The seat of claim 1, wherein each leg member further comprises a push button assembly that is positioned to attach the lower leg section to the upper leg section.

* * * * *